US011824250B2

(12) United States Patent
Weber et al.

(10) Patent No.: US 11,824,250 B2
(45) Date of Patent: Nov. 21, 2023

(54) ANTENNA HOUSING WITH A PROFILE ELEMENT FOR WIND LOAD REDUCTION

(71) Applicant: Telefonaktiebolaget LM Ericsson (publ), Stockholm (SE)

(72) Inventors: Stefan Weber, Söchtenau (DE); Eckart Stuible, Brannenburg (DE); Stefan Eschrig, Rosenheim (DE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 34 days.

(21) Appl. No.: 17/432,305

(22) PCT Filed: Feb. 19, 2020

(86) PCT No.: PCT/EP2020/054382
§ 371 (c)(1),
(2) Date: Aug. 19, 2021

(87) PCT Pub. No.: WO2020/169679
PCT Pub. Date: Aug. 27, 2020

(65) Prior Publication Data

US 2022/0173492 A1 Jun. 2, 2022

(30) Foreign Application Priority Data

Feb. 20, 2019 (DE) ..... 10 2019 104 285.2

(51) Int. Cl.
*H01Q 1/00* (2006.01)
*H01Q 1/42* (2006.01)

(52) U.S. Cl.
CPC ..... *H01Q 1/005* (2013.01); *H01Q 1/42* (2013.01)

(58) Field of Classification Search
CPC ..... H01Q 1/005; H01Q 1/42
USPC ..... 343/872
See application file for complete search history.

(56) References Cited

U.S. PATENT DOCUMENTS

| | | | |
|---|---|---|---|
| 6,726,407 | B1 | 4/2004 | Steinkamp et al. |
| 2006/0043770 | A1 | 3/2006 | Preiss |
| 2021/0091449 | A1* | 3/2021 | Weber ..... H01Q 1/42 |

FOREIGN PATENT DOCUMENTS

| | | | |
|---|---|---|---|
| DE | 102016112701 | A1 | 1/2018 |
| EP | 3073564 | A1 | 9/2016 |
| JP | 2004138572 | A | 5/2004 |

OTHER PUBLICATIONS

Examination Report for German Patent Application No. 102019104285.2, dated Jan. 30, 2020, 13 pages.
International Search Report and Written Opinion for International Patent Application No. PCT/EP2020/054382, dated Jun. 2, 2020, 13 pages.
Examination Report for European Patent Application No. 20706688.7, dated Sep. 12, 2023, 6 pages.

* cited by examiner

*Primary Examiner* — Peguy Jean Pierre
(74) *Attorney, Agent, or Firm* — Withrow & Terranova, PLLC

(57) ABSTRACT

What is proposed is an antenna housing comprising at least one profile element fastened on an area of the antenna housing at a distance from said housing and shaped so that it channels an airstream striking the antenna housing so that a part of the airflow is channelled between the profile element and the antenna housing.

12 Claims, 10 Drawing Sheets

ANTENNA HOUSING WITH A PROFILE ELEMENT FOR WIND LOAD REDUCTION

This application is a 35 U.S.C. § 371 national phase filing of International Application No. PCT/EP2020/054382, filed Feb. 19, 2020, which claims the benefit of German Application No. DE 10 2019 104 285.2, filed Feb. 20, 2019, the disclosures of which are incorporated herein by reference in their entireties.

The invention relates to an antenna housing with a profile element for wind load reduction.

The need to transfer large data volumes is increasing in the field of mobile radio antennas. The respective antennas are becoming increasingly more complex and require more space in spite of high integration density. Since the antennas are generally fastened to a pole, the wind load acting on the antennas and therefore the pole becomes a problem—and not only when antennas are being replaced. It is therefore becoming increasingly more important to provide antennas, in particular the antenna housings thereof, that contribute to a wind load reduction.

It is therefore the task of the invention to provide an antenna housing with a profile element to reduce wind load and, at the same time, the best-possible transmission properties of HF technology. In particular, this means that the wind load acting on the antenna from different directions must be reduced without impairing electrical properties.

According to the invention, this task is solved by the features of the independent claims. Advantageous embodiments are the subject-matter of the dependent claims.

What is proposed is an antenna housing comprising at least one profile element fastened to an area of the antenna housing and at a distance from the same, shaped in such a way that it channels any airflow striking the antenna housing so that some of the airflow is channelled between the profile element and the antenna housing.

The profile element reduces the wind load that is generated by the airflow striking the antenna housing both in the main flow direction at angle of 0 degrees, i.e., when the airflow strikes the front area of the antenna housing director, and also in the case in which it strikes the antenna housing at an angle of up to +/−45 degrees. The profile element furthermore serves to channel any airflow striking the antenna housing so that the airflow circulates around the antenna body better at the (blunt) body edges, which reduces the wake area, thus lowering the air resistance. This means that, in the ideal case, no or only a small and/or flat wake area is created along the antenna housing subjected to airflow. In other words, the low-resistance, direct circulation is longer and closer to the housing so that it detaches later. This prevents aerofoil-like effects, i.e., the airflow does not cause the undesired lift. As a result, the air resistance and thus the wind load created by the circulation of the airflow around the antenna housing and thus the entire antenna is reduced. This reduction can be measured in the wind tunnel, for example.

The arrangement of the profile element is determined by a person skilled in the art depending on the type and shape of the antenna housing and the type, shape and design of the structure, for example by means of tests in the wind tunnel. In this context, the wind load is measured at the same location or in the same area at different speeds, creating a respective measurement curve of the wind load for different wind speeds. Consequently, a comparison can be made between the wind load acting on the antenna housing with and without a profile element at different wind speeds to obtain a direct comparison.

In one embodiment, the profile element extends at least along a partial section of the height of the antenna housing. The profile element may extend along the entire height of the antenna housing. It may also be longer than the height of the antenna housing at one or both ends, i.e., protrude from it. It may also, however, be shorter than the height of the antenna housing.

In one embodiment, the profile element is formed in one piece, i.e., in one piece across its entire length and/or height, or as a multi-piece profile element. If a multi-piece profile element is formed, it may be formed from parts that are separate from each other, which are joined together, or which are not joined together.

Due to the very high number of alternatives for the shape of the antenna housing and the structure and the resulting combinations, it is not possible to provide here an exact location for the arrangement of the structure. Rather, the area where the flow stalls must be individually specified for each housing shape, i.e., with a test series in the wind tunnel.

In one embodiment, the at least one profile element is arranged on a side area, in which case a profile element is preferably provided on both side areas. It may also be arranged on a front area, in which case, depending on the arrangement, at least two profile elements are arranged at a distance from each other, preferably close to the corners of the antenna housing. The profile element may also be arranged on a rear area opposite the front area, in which case, depending on the arrangement, at least two profile elements are arranged at a distance from each other, preferably close to the corners of the antenna housing. It may also be arranged on a transition area between two areas of the antenna housing, in which case a profile element is preferably provided on both transition areas between the front area and/or on the rear area and the side area. Profile elements may be provided in several areas as well, i.e., on the side areas and additionally on the front area and/or the rear area. Profile elements may also be provided on the front area and the rear area. Further, depending on the embodiment, profile elements may be provided on the transition areas as well. Any sensible combination of profile elements is therefore possible.

As stated in the description, two profile elements are generally provided, in which case these are symmetrical to the axis and/or the plane which halves the antenna housing along its width.

Different alternatives for arranging profile elements on an antenna housing for reducing wind load on the antenna housing are described below. It is obvious in this regard that, depending on the placement of the profile element on the antenna housing, a corresponding suitable shape for the profile element must be chosen in order to channel a striking airflow so that the latter also passes between the antenna housing and the profile element.

In one embodiment, one respective profile element is provided on each of the transition areas between the front area and an adjacent side area. Alternatively, one respective profile element is provided on each of the transition areas between the rear area and an adjacent side area of the antenna housing.

In one embodiment, one respective profile element is arranged on each of the side areas of the antenna housing, and the width of the profile element is smaller than the depth of the antenna housing or almost equivalent to the depth of the antenna housing. Alternatively, the profile element, or more specifically its ends, protrudes in a specified length from the depth of the antenna housing toward the front area and/or the rear area of the antenna housing.

In one embodiment, two profile elements are arranged on the rear area so that they each protrude from a respective side area or are substantially flush with the latter.

In one embodiment, the profile element has one of the following shapes: concave on both sides, convex on both sides, concave/convex, rectangular, square, semi-circle or oval. The profile element may also have a shape that is adapted to the side of the shape of the antenna housing that faces the antenna housing, i.e., a complimentary contour. The shape of the profile element depends on the shape of the antenna housing as well as other ancillary conditions, which may vary depending on the installation situation, for example the expected striking airflow, the (main) direction of the expected striking airflow or the availability of space. The profile elements preferably comprise more complex shapes in one direction and a relatively high rigidity against forces in the direction of flow and transversely from it. The transverse stability is important for the suppression of vibrations of the profile element and the associated impact on the electrical properties of the antennas as well as the material fatigue due to the force of gravity. In one embodiment, the profile element is therefore formed from aluminium, e.g., extruded aluminium profiles, or plastic and/or glass fibre-reinforced plastic.

In one embodiment, the profile element has through-openings from a side facing the antenna housing to a side facing away from the antenna housing. This is done to use the effect of the boundary layer suctions. A Laval nozzle is created between the profile element and the antenna housing, in which case, due to the air flowing through the through-opening, the dynamic pressure is reduced, and suction occurs at the boundary layer. The suction at the boundary layer decreases the effective flow cross-section.

In one embodiment, the profile element is arranged on the antenna housing across at least two fastening elements spaced apart from each other or by one fastening rail, which may be designed as a fastening strip as well. Preferably, the fastening element and/or the fastening rail is fastened to the antenna housing by means of an adhesive bond. The profiles are rigidly fastened on the antenna housing at a defined distance. Preferably, they are fastened so that vibrations in the antenna Y-direction are avoided. To prevent holes and, therefore, leaks of the antenna housing, it is possible to fasten them with adhesive mounts. To this purpose, threaded bolds with relatively large, transparent elastomer pads, on which the profile elements can be fastened, are affixed.

The antenna housing has substantially the shape of a cuboid with a front area, side areas, a rear area, a cover, and a base, with transition areas or corners or edges being present between the side areas and the front area and between the side areas and the rear area, which connect these areas with each other. The corners and/or areas may be both sharp and rounded.

Further features and advantages of the invention follow from the description of exemplary embodiments of the invention, the figures of the drawings, which shows details according to the invention, and the claims below. The individual features may be realised each individually or in a variant of the invention as a plurality in any combination. Preferred embodiments of the invention are explained in further detail below on the basis of the enclosed drawings.

Figure 11:
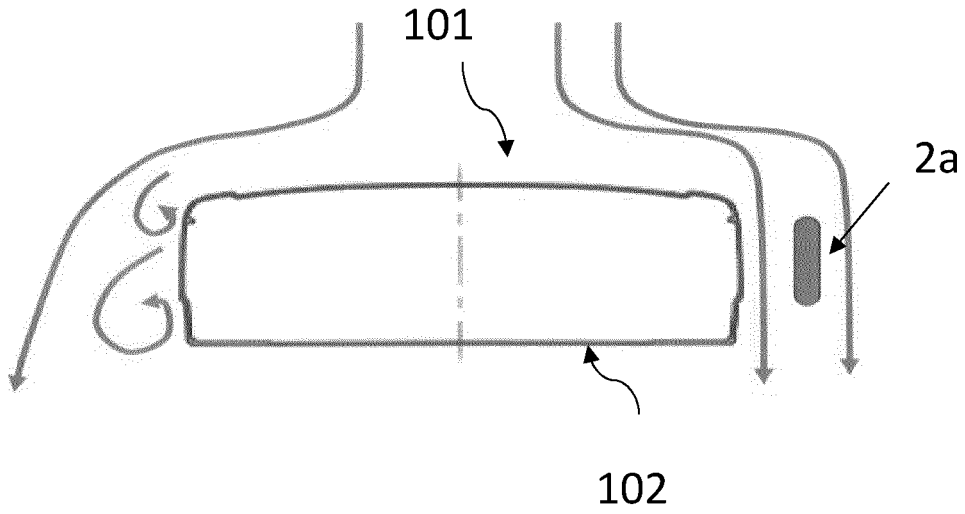
Figure 12:
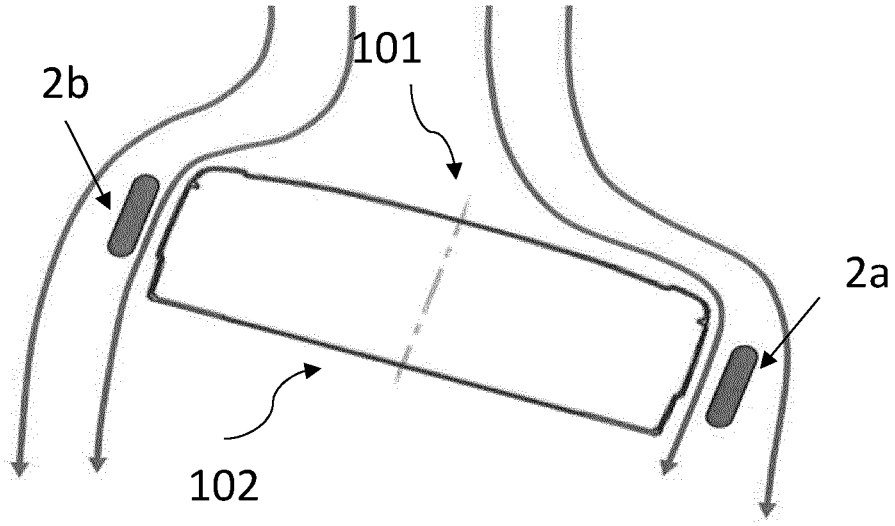
Figure 13:
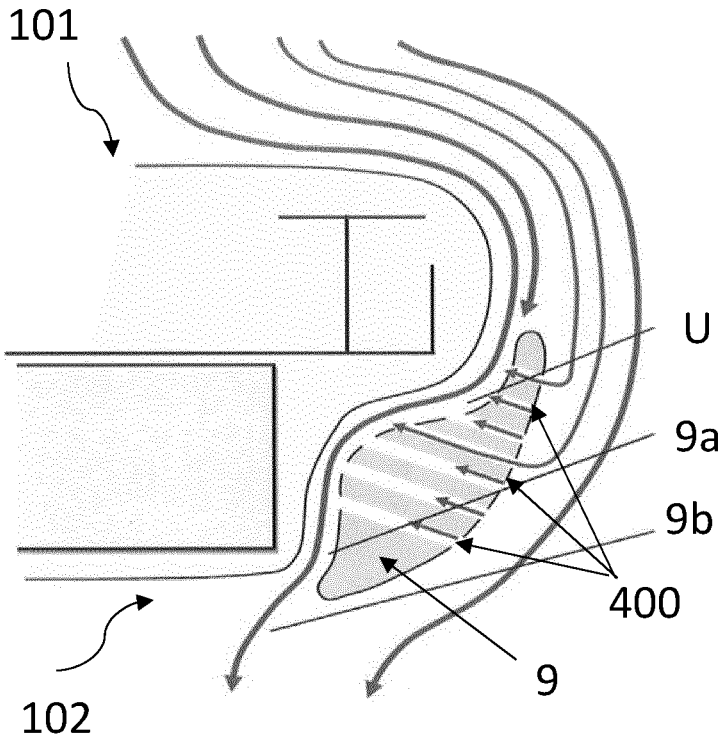
Figure 14:
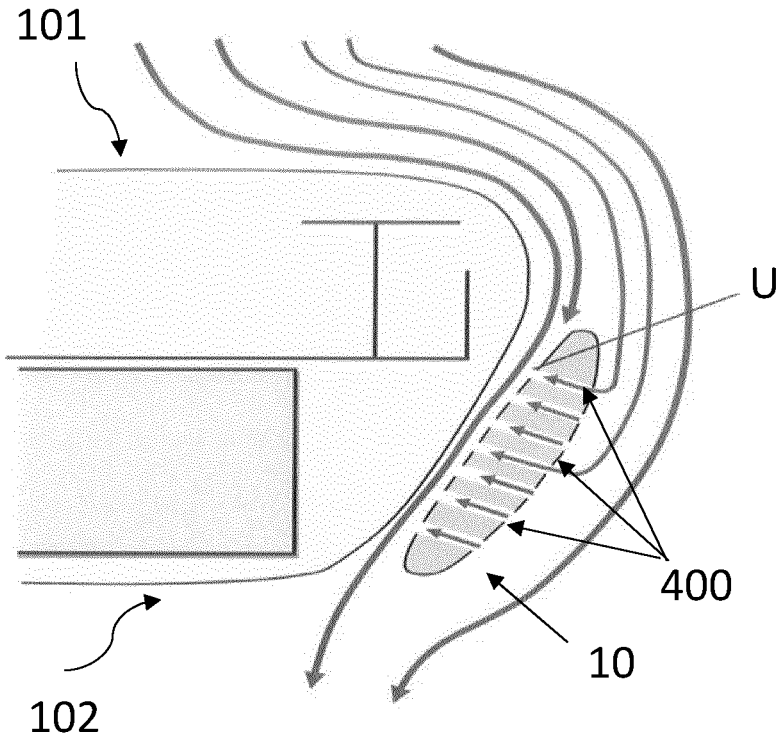
Figure 15:
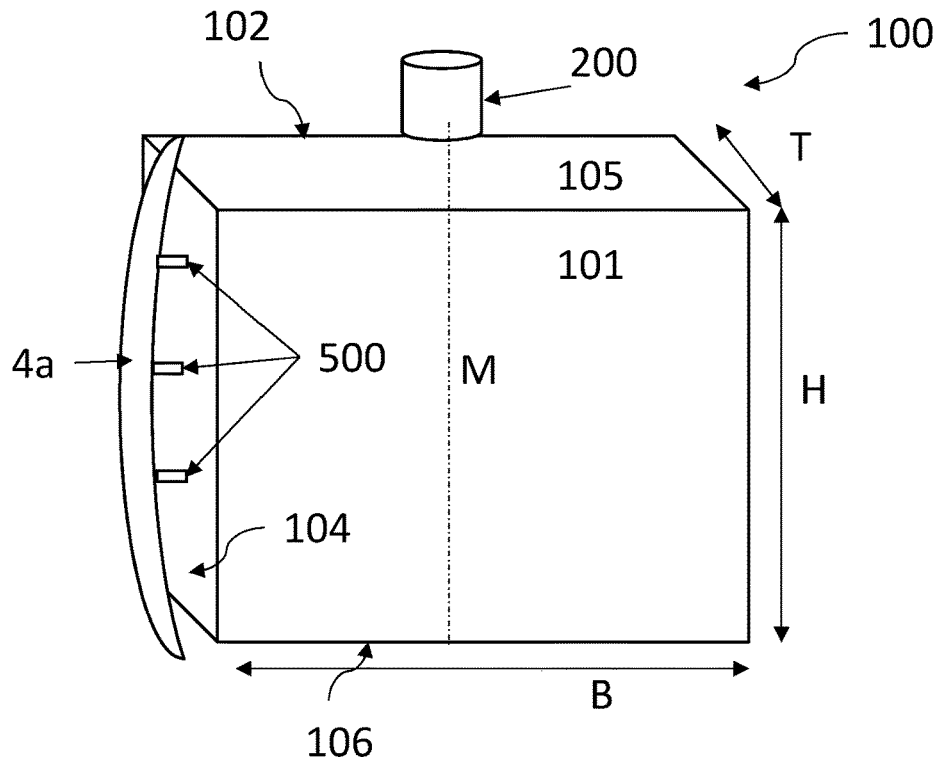
Figure 16:
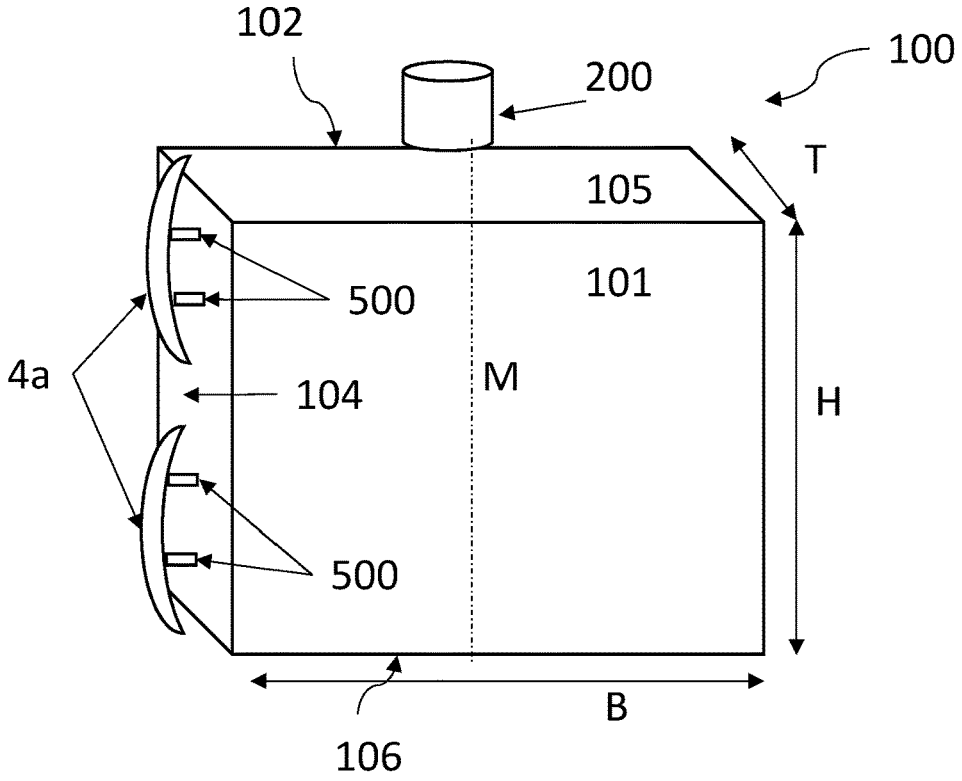
Figure 17:
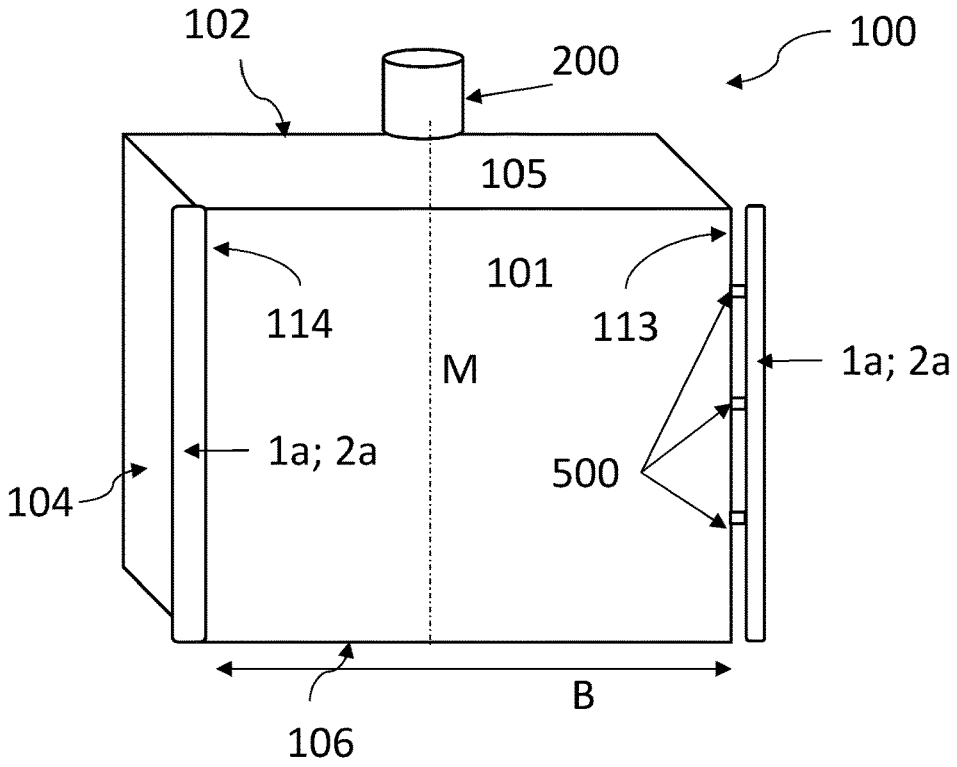
Figure 18:
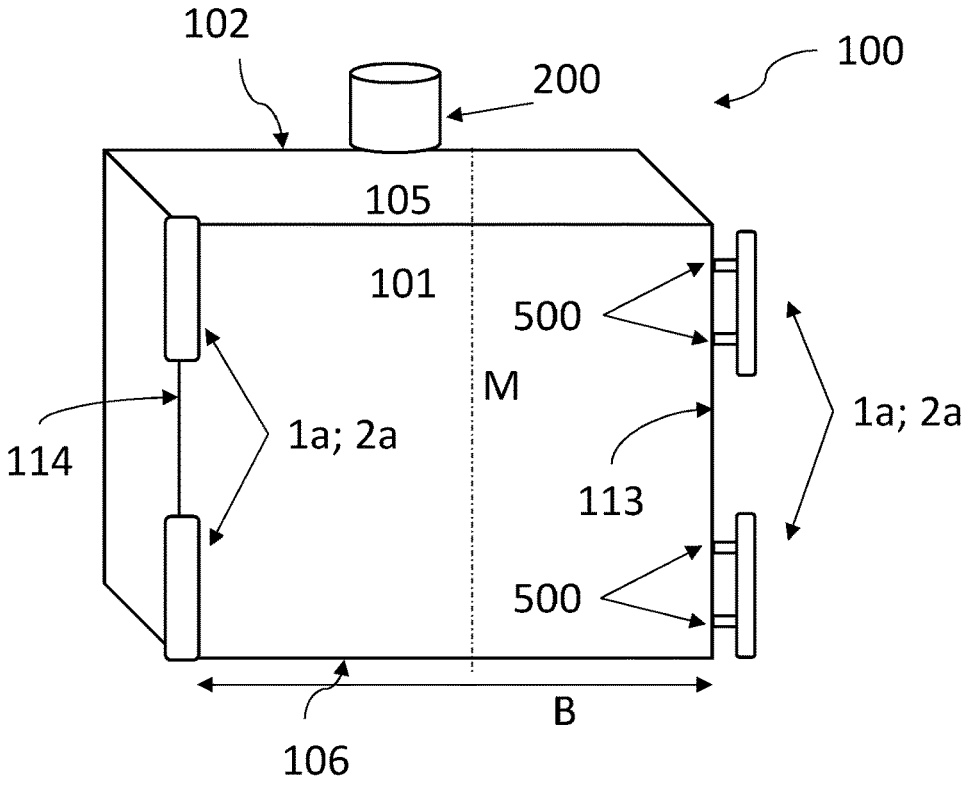
Figure 19:
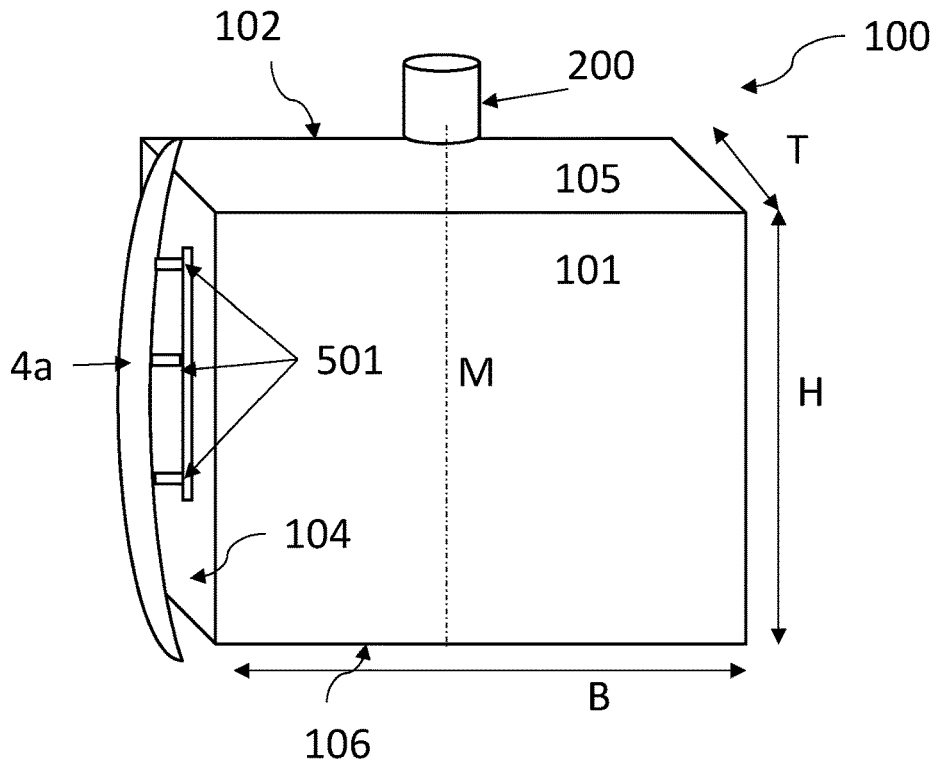
Figure 20:
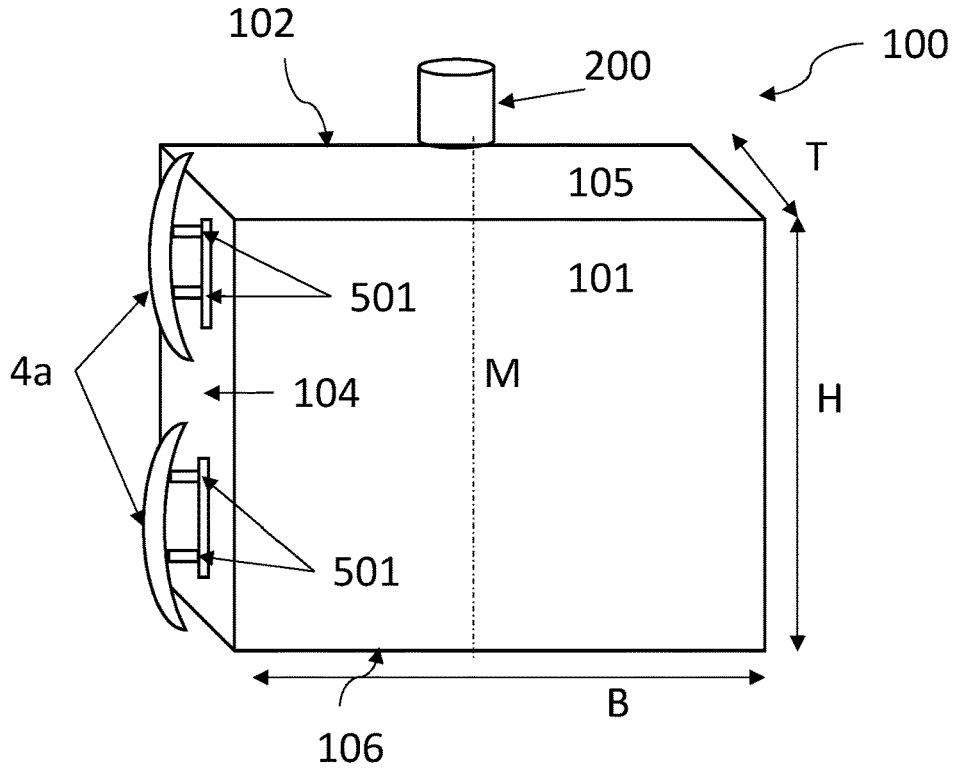

FIGS. 10*a-f* show different profiles of the profile element;

FIGS. 11 and 12 schematise different flow directions and effects of the profile elements according to different embodiments of the present invention;

FIGS. 13 and 14 schematise different flow directions and effects of the profile elements with through-openings according to different embodiments of the present invention;

FIGS. 15, 17 and 19 show different fastening options for one-part profile elements; and FIGS. 16, 18 and 20 show different fastening options for multi-part profile elements.

In the descriptions of the figures below, the same elements and/or functions are provided with the same reference signs.

In the known applications outside of antenna technology, air control elements are known that are intended to achieve an improvement of the aerodynamics for a dominant flow direction. Mobile radio antennas are, however, exposed to airflows from all directions and must perform an electrical function. The profile elements are therefore specifically adapted to the shape of the antenna and do not impair the electrical function.

The description below focuses on mobile radio antennas which are hung on a pole 200 that is relatively free-standing in most cases, since this is where the greatest wind loads are expected. The embodiments described below may, however, be used for antennas arranged elsewhere, including those not used for mobile radios, even movable antennas. Antenna housings 100, which encompass the actual antenna, i.e. in particular the radome, are generally formed so that the shape of the antenna housing 100 is adapted to the electrical properties of the antenna. Since the antenna housing 100 encompasses the antenna, which means that it is exposed to environmental influences, it is also necessary, however, to design the antenna housing 100 so that the wind load is reduced.

The invention is described below on the basis of antenna housings 100, which approximately have the shape of a cuboid with a defined height H, width W and depth T. Especially antenna housings 100 with relatively sharp flanging radii benefit from the profile elements 1*a*-8*a*; 1*b*-8*b*; 9; 10 described here because it is possible to reduce the wind load with an arrangement on the rear side or the rear area 102, on side areas 103, 104 or transition areas 113, 114, 123, 124, i.e., on the corners of the radome. In general, the corners and/or the edges of the housing 100 may be rounded as well.

Other shapes of antenna housings are possible as well, however, if the structure described below is adapted accordingly to adjust the wind load acting on the antenna housing.

An antenna housing 100 described below comprises a front wall or a front area 101, two side walls or two side areas 103, 104, a base 106, a cover 105 and a rear wall or a rear area 102, as can be seen in greater detail in FIGS. 15 to 20. An antenna housing 100 fastened to a pole 200 is generally fastened to the same with its rear side, hereinafter also referred to as the rear area 102, so that especially its front side, hereinafter also referred to as the front area 101, is exposed to the striking airflow such as wind. If the antenna housing 100 is fastened to the pole 200 in a slanted manner, other areas, for example one of the side walls, also referred to as the side areas 103, 104, are exposed to a wind load caused by the striking airflow.

The wind load may become an issue if the pole 200 is not designed for such a load. This may be the case when old antennas are replaced with antennas of a newer generation, which are becoming increasingly larger and heavier due to the increasingly complex requirements and the need for high data rates, which requires additional components. Due to the increasing size, they are exposed to a higher wind load as well because the air resistance alone is increased by the larger front of the front side 101. Additionally, the following effect can be observed: an abrupt stall occurs at the edges and/or the transition areas 113, 114; 123, 124, for example from the front area 101 to one of the side walls 103, 104 or from the rear area 102 to one of the side walls 103, 104, even when the edges are rounded, which leads to a higher air resistance and thus a higher wind load due to the wake area created behind the edge 113, 114; 123, 124. In the event of a frontal flow, the flow often stalls at the side edges of the currently known profiles, which means that the flow cannot flow to the profile and stalls. The smaller the radius of the edge, the earlier the flow will stall. The stall leads to a distinctive wake area, which has a larger cross section than the antenna. This cross section is relevant for the air resistance. The earlier and the sharper the stall occurs, the greater the wake area and thus the air resistance. FIGS. 2, 9, 11-14 schematically show air flows and their channelling between the antenna housing 100 and different profile elements 1*a*-8*a*; 1*b*-8*b*; 9; 10. The vortices identify the wake area. FIGS. 11 and 12 basically show the same embodiment as FIG. 3, only with a schematised airflow.

In the event of a frontal flow onto the antenna housing 100, a stall forms at the side edges 113, 114; 123, 124 as shown in FIG. 11. This means that the flow cannot follow the profile of the antenna housing 100 and stalls. The smaller the edge radius, the earlier the flow will stall. The stall leads to a distinctive wake area, which has a larger cross section than the antenna. This cross section is relevant for the air resistance. The earlier and the sharper the stall occurs, the greater the wake area and thus the air resistance. In the event of a slanted flow, i.e., if an airflow strikes at an angle of approximately +/−45 degrees, a stall occurs only at the front edge of the side of the antenna housing 100 facing away from the flow. This stall is dominant for rounded profiles because it is much more distinctive compared to the stall of rounded profiles and generates a very large wake area. The air resistance has a maximum for rounded profiles in the case of a side flow.

The profile elements 1*a*-8*a*; 1*b*-8*b*; 9; 10 fastened on the side or the spoilers cause the airflow to be divided into an airflow in the gap between the profile elements 1*a*-8*a*; 1*b*-8*b*; 9; 10 and the antenna housing 100 and a flow that passes on the outside of the profile element 1*a*-8*a*; 1*b*-8*b*; 9; 10. The flow in the gap is forced by the profile element 1*a*-8*a*; 1*b*-8*b*; 9; 10 to stay close to the antenna. By means of a suitable shape design, even the air passing on the outside stays close to the profile element 1*a*-8*a*; 1*b*-8*b*; 9; 10. This significantly reduces the wake area. In the event of a transverse flow, the wake area is reduced on the side facing away from the flow due to the profile elements 1*a*-8*a*; 1*b*-8*a*; 9; 10.

Figure 1:
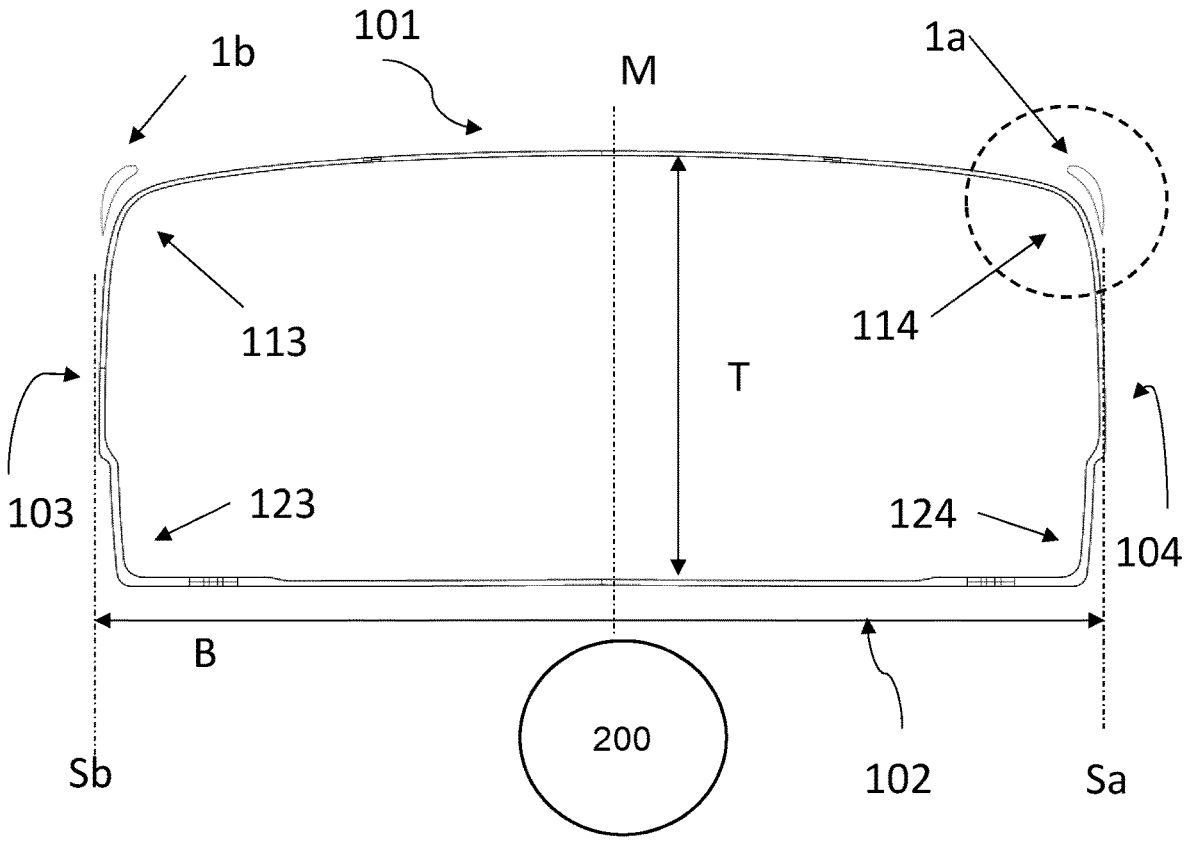
FIG. 1 shows profile elements arranged on a transition area according to one embodiment of the present invention.
Figure 2:
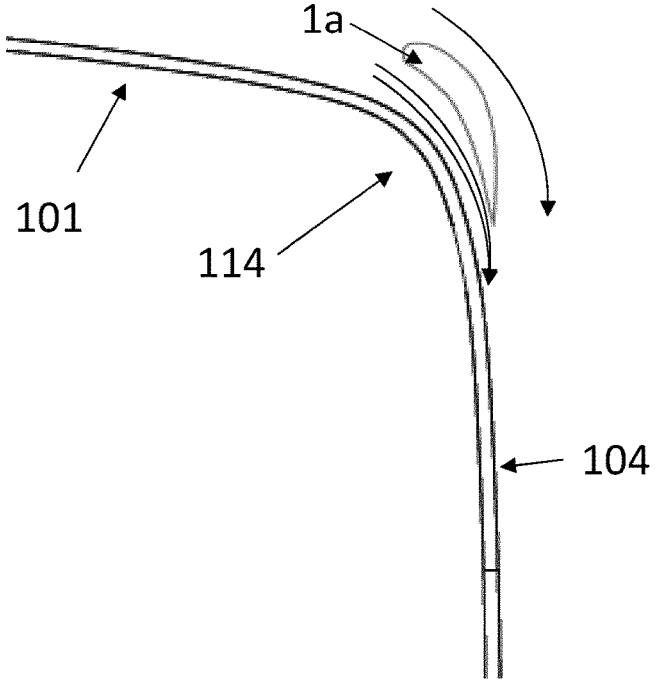
FIG. 2 shows an enlarged view of the area marked in FIG. 1.

As already described, profile elements 1*a*-8*a*; 1*b*-8*b*; 9; 10 fastened to a side area 103 or 104 of the antenna housing 100 cause the air flow to be divided into an air flow in the gap between the profile element 1*a*-8*a*; 1*b*-8*b*; 9; 10 and the antenna housing 100 and a flow that passes on the outside. The flow in the gap is accelerated by a nozzle-shaped embodiment as schematically shown in FIGS. 1 and 2 as well as 13 and 14. According to Bernoulli, the acceleration causes a reduction of the dynamic pressure with the overall pressure remaining the same. This underpressure can be used to apply suction to the boundary layer flow, which passes on the outside of the profile element 9; 10 via channels or through-openings 400 in the respective profile element 9; 10. The airflow suction causes the flow to occur closer to the profile of the antenna housing 100 and tends to detach later than an airflow that is channelled only by means of profile elements 1*a*-8*a*; 1*b*-8*b*. The wind load of the antenna depends on the size of the vortex in the wake. The smaller the field of the wake, the smaller the air resistance of the antenna. FIGS. 13 and 14 show profile elements 9 and 10, which, due to their shape, act as a nozzle and thus generate an underpressure U. Especially the profile element 9 that is adapted to the contour of the antenna housing 100, see FIG. 13, provides a nozzle extension 9*a* at a position where the airflow exits between the profile element 9 and the antenna housing 100. It can be clearly seen here that a wake area 9*b* is actively ventilated by this shape and thus furthers the effect of the wind load reduction even more. The airflow through the nozzle can be used to ventilate the wake area. The exiting air makes it possible to push the vortex area of the wake area away from the rear side. The farther the vortexes move away from the antenna, the lower the underpressure U induced there, which causes the air resistance to decrease.

As taught in regard to flow, the term "wake area" refers to an area in which a flow located in the wake of a body exposed to airflow, for example, runs counter to the main direction of flow so that undesired effects such as a higher air resistance are created. A body exposed to a flow generally experiences resistance. This resistance can be divided into individual components, which have different causes. In the case of blunt bodies (e.g., cuboids), this is generally the flow resistance. This resistance is composed of a friction resistance and the pressure resistance. The wake area is mainly responsible for flow resistance. The other types of resistance caused by surface friction, interference resistance, and induced resistance play a subordinate role with respect to blunt bodies in aerodynamics.

The pressure or suction acting on an object due to the wind acting on the object is referred to as the wind load. This leads to a pressure load on that object per unit area.

Depending on the shape and surface of a contour exposed to flow, the flow will stall sooner or later and, again depending on the shape, a reversal from a laminar to a turbulent flow will occur. Transitions from laminar to turbulent flow are incoherent processes, which means that they depend on the direction of flow and the change of the direction of flow. The reversal from a laminar to a turbulent flow is not locally stable either, which means that, depending on the periodically reciprocally arising vortex shedding, the point (or more specifically an area where a small bubble forms) of the flow reversal from laminar to turbulent changes.

The problem of reducing the wind load on antenna housings 100, specifically housings for mobile radio antennas, is solved by the profile elements 1*a*-8*a*; 1*b*-8*b*; 9; 10 fastened to the antenna housing 100 in the manner described below. The profile elements 1*a*-8*a*; 1*b*-8*b*; 9; 10 may have any number of shapes and sizes as described below on the basis of exemplary embodiments. The profile elements 1*a*-8*a*; 1*b*-8*b*; 9; 10 are furthermore fastened to the antenna housing 100, preferably at a distance from it, so that the striking airflow can be channelled between the antenna housing 100 and the profile element 1*a*-8*a*; 1*b*-8*b*; 9; 10.

For passive antennas, the profile elements 1*a*-8*a*; 1*b*-8*b*; 9; 10 may, for example, be positioned in the middle of the side line of the antenna housing 100 to achieve similar properties for the frontal and the rearward flow. For new, active antennas with cooling elements 300 for the amplifier and the filter (without a fan), it is preferable to arrange the profile elements 1*a*-8*a*; 1*b*-8*b*; 9; 10 in such a way that a good circulation of the coolers 300 in the frontal direction is possible even at low wind speeds, thereby increasing the cooling performance.

The figures that have not yet been described in detail will be described below.

FIG. 1 shows a top view of an antenna housing 100 with a front area 101, a rear area 102, which is fastened to a pole 200, as well as two side areas 103 and 104. There is one transition area 113 and 114 each between the front area 101 and the side areas 103 and 104. There is one transition area 123 and 124 each between the rear area 102 and the side areas 103 and 104 as well. The transition areas 113, 114, 123, 124 are the edges of the antenna housing 100.

FIG. 1 also shows a profile element 1*a* and 1*b*, which is fastened to each transition area 113 and 114 between the front area 101 and the side area 103 or 104. The profile element 1*a* and 1*b* basically has the shape of a drop, i.e., one end area is tapered (toward the side area 103 or 104), and the other is rounded in a bending radius (toward the front area 101). The profile element 1*a* and 1*b* is furthermore shaped in a curved manner to follow the contour of the antenna housing 100 or more specifically the transition area 113 or 114, and thus makes it possible to channel a striking airflow so that part of it flows between the profile elements 1*a* and 1*b* and the transition area 113 or 114. FIG. 2 shows an enlargement of the area marked in FIG. 1 with the dotted circle. The channelling of the airflow is shown here schematically (as black lines with an arrow in the direction of flow). Part of the airflow is channelled between the profile element 1*a* and the transition area 114. The part of the airflow that is not channelled between the profile element 1*a* and the transition area 114 passes along the outside of the profile element 1*a*. Due to the rounding of the profile element 1*a*, the airflow is channelled along the profile or the transition area 114 here as well and does not stall until later.

Figure 9:
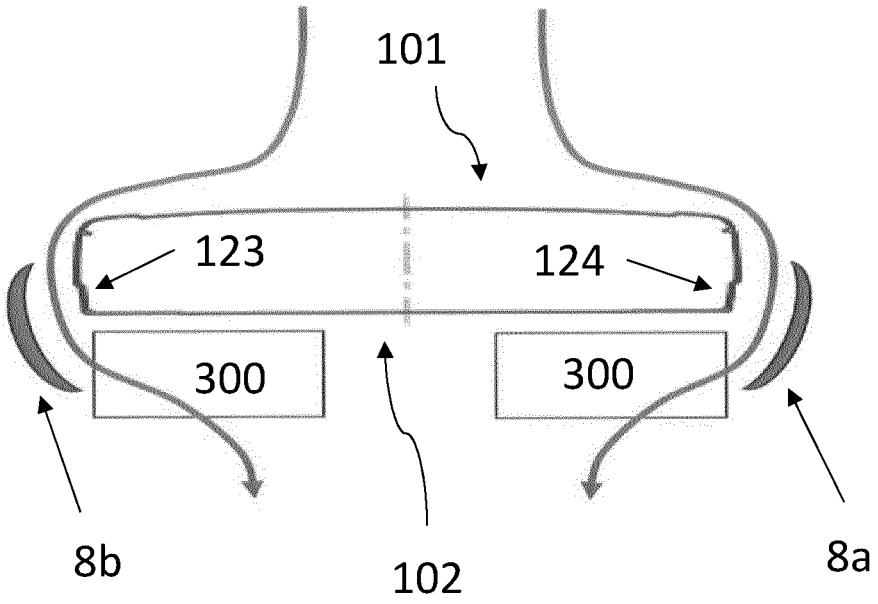
FIG. 9 shows profile elements arranged on a transition area and the diverted airflow according to a further embodiment of the present invention.

FIG. 9 shows another embodiment in which the profile element 8*a* or 8*b* is arranged on a transition area 123 or 124 but here on the transition area 123 or 124 toward the rear area 102. In this embodiment, it is arranged at a larger distance from the antenna housing 100 because the airflow is to be channelled between the profile element 8*a* or 8*b* and the transition area 123 or 124 in such a way that a cooling element 300 provided on the rear area 102 is to be circulated by the air channelled through the profile element 8*a* or 8*b* to improve the cooling effect.

Preferably, both profile elements 1*a* and 1*b* or 8*a* and 8*b* are identically arranged on the respective transition areas 113, 114 or 123, 124. This means that they are arranged symmetrically with respect to the axis or plane M, which halves the antenna housing in its width.

Figure 3:
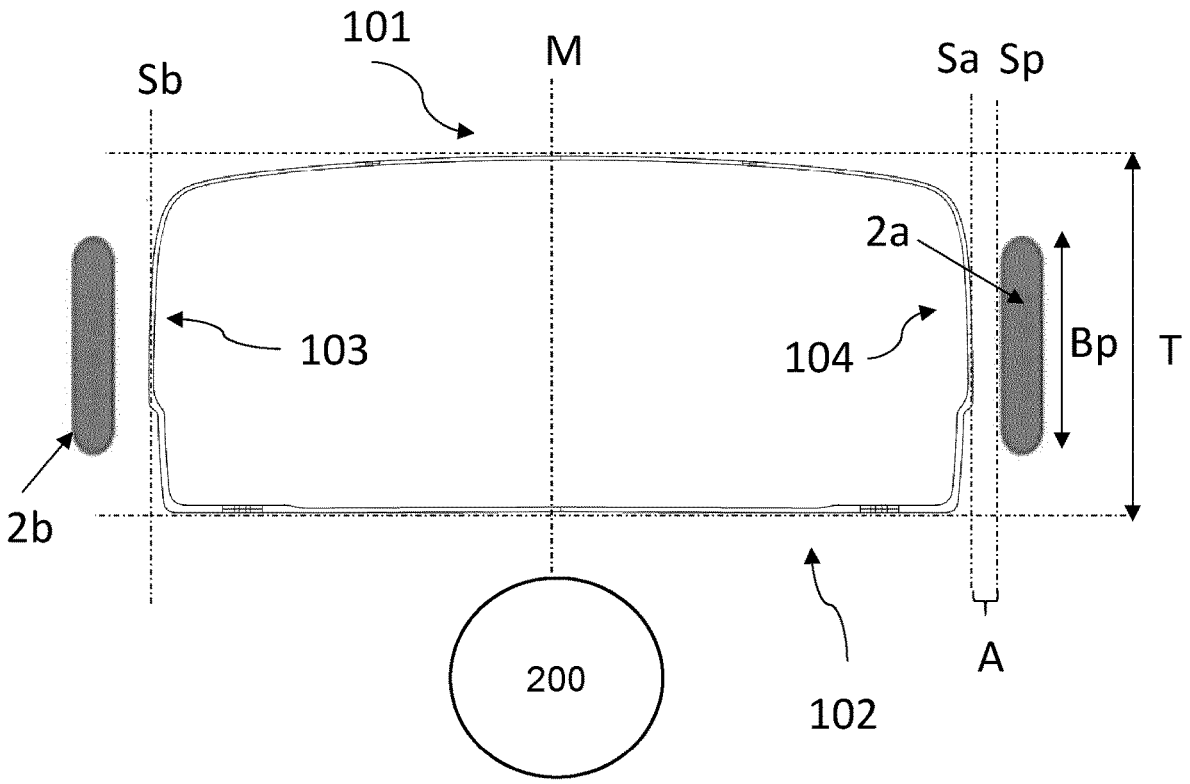
FIGS. 3 to 8 show profile elements arranged on different areas according to further embodiments of the present invention.
Figure 4:
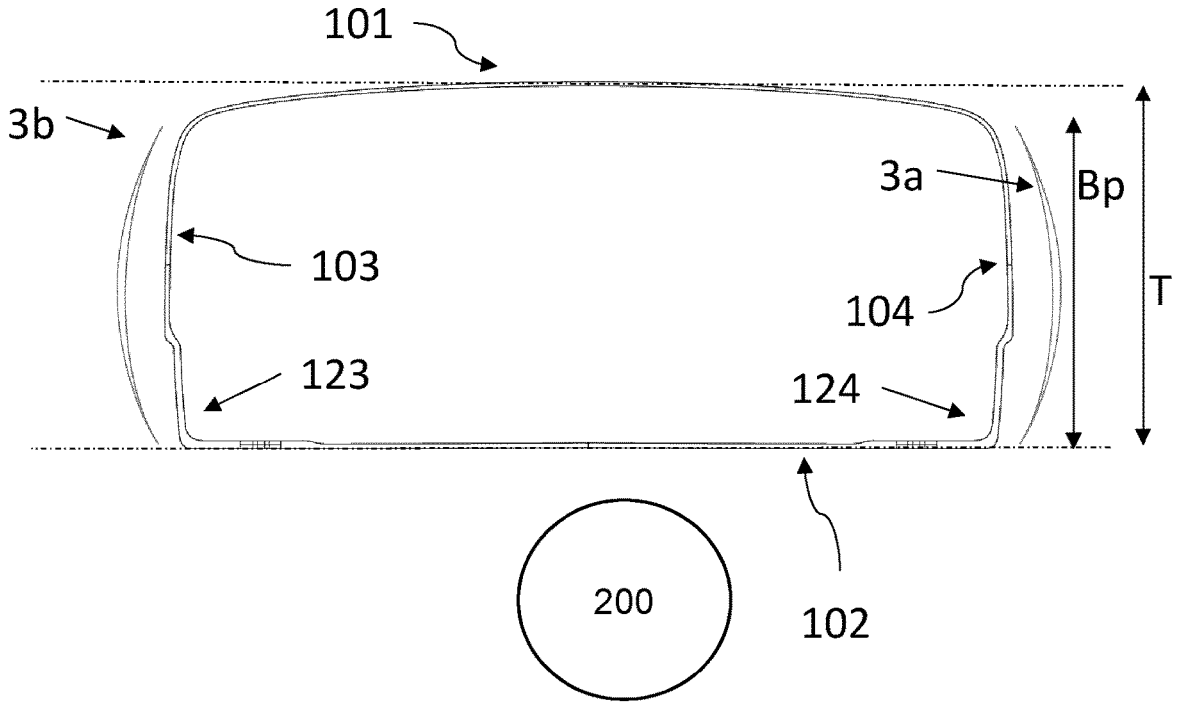
Figure 5:
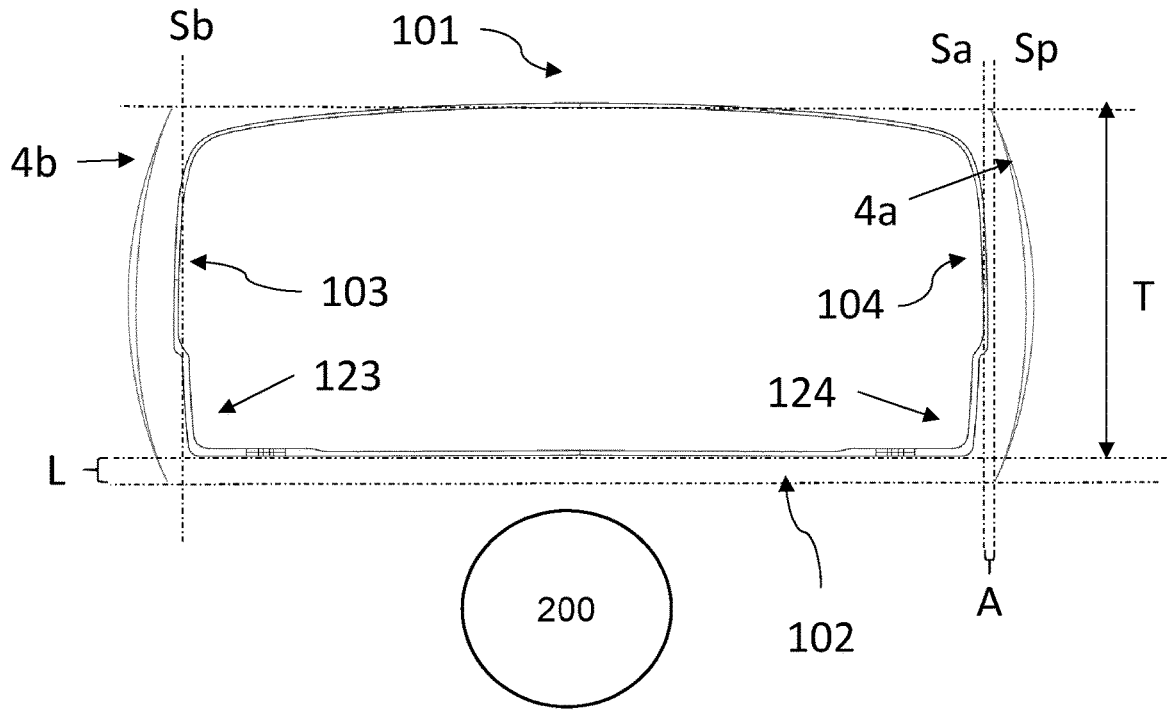

FIGS. 3 to 5 show top views of the antenna housing 100 with profile elements 2*a*, 2*b*; 3*a*, 3*b*; 4*a*, 4*b* arranged on side area 103 or 104. FIG. 3 shows straight profile elements 2*a*, 2*b* with a width Bp that is shorter than the depth of the antenna housing 100 or of its side area 103 or 104. FIGS. 4 and 5 show profile elements 3*a*, 3*b* or 4*a*, 4*b* which curve away from the side area.

The difference between the two profile elements 3*a*, 3*b* and 4*a*, 4*b* is explained below. In FIG. 4, the width Bp of the profile element 3*a* or 3*b* corresponds at the most to the depth T of the antenna housing 100 or more specifically of the side area 103 or 104. The width Bp of the profile element 3*a* or 3*b* is less than the depth T with one end of the profile element 3 or 3*b* being flush with an imaginary line to the extension of the rear area 102 (indicated by the dotted line in FIG. 4) and ending substantially at the height of the apex of the transition area 113 or 114. In FIG. 5, the width Bp of the profile element 4*a* or 4*b* is greater than the depth T of the antenna housing 100, more specifically the side area 103 or 104. It corresponds to T+L, in which context L is a defined length in which one or both ends of the profile element 4*a* or 4*b* protrude from the front area 101 and/or the rear area 102. FIG. 5 only shows a protrusion from the rear area 102 by the length L. When the profile element 4*a* or 4*b* protrudes from both the front area 101 and the rear area 102, its width is Bp=T+2L.

Preferably, both profile elements 3*a* and 3*b* or 4*a* and 4*b* are each identically arranged on the respective side area 103 or 104. This means that it is symmetrically arranged to the axis and/or the plane M which halves the antenna housing 100 in its width.

The shown profile elements 2*a*, 2*b*; 3*a*, 3*b*; 4*a*, 4*b* arranged on side areas 103 or 104 may vary in their width Bp regardless of the shape chosen. As already mentioned, a person skilled in the art may, depending on the shape of the antenna housing 100 and the location and surroundings of the application of any number of profile elements, select their shape, width, characteristics, type, for example one-piece or multi-piece, and even the type of their fastening. Consequently, it is not possible to reflect all combinations in the figures.

The profile elements 2*a*, 2*b*; 3*a*, 3*b*; 4*a*, 4*b* are arranged at a distance A from the side area 103 or 104. This distance may be selected depending on the design of the profile element 2*a*, 2*b*; 3*a*, 3*b*; 4*a*, 4*b*. In FIG. 3, it is the distance A between an imaginary line Sa or Sb along the side area 103 or 104 and an imaginary line Sp along the longitudinal side of the profile element 2*a* or 2*b* facing this area. In FIGS. 4 and 5, the distance A is the distance between an imaginary line Sa or Sb along the area 103 or 104 and an imaginary line Sp between the ends of the profile elements 3*a*, 3*b* or 4*a*, 4*b*.

Figure 6:
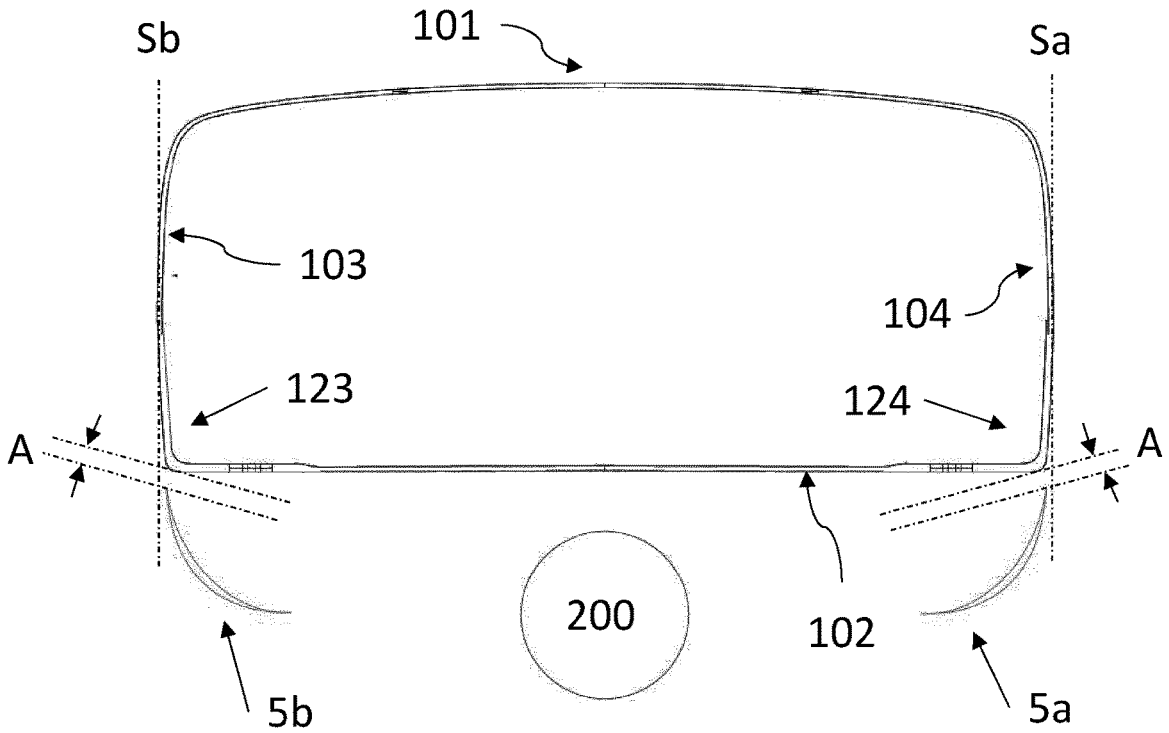
Figure 7:
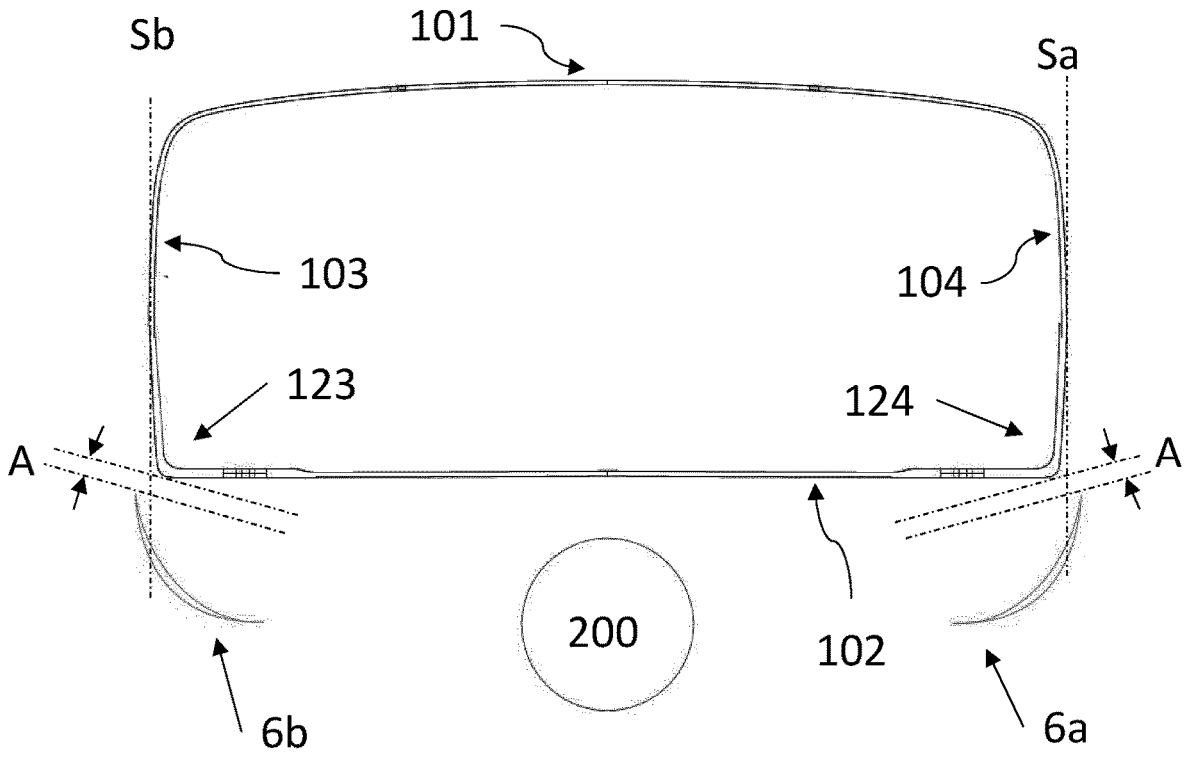
Figure 8:
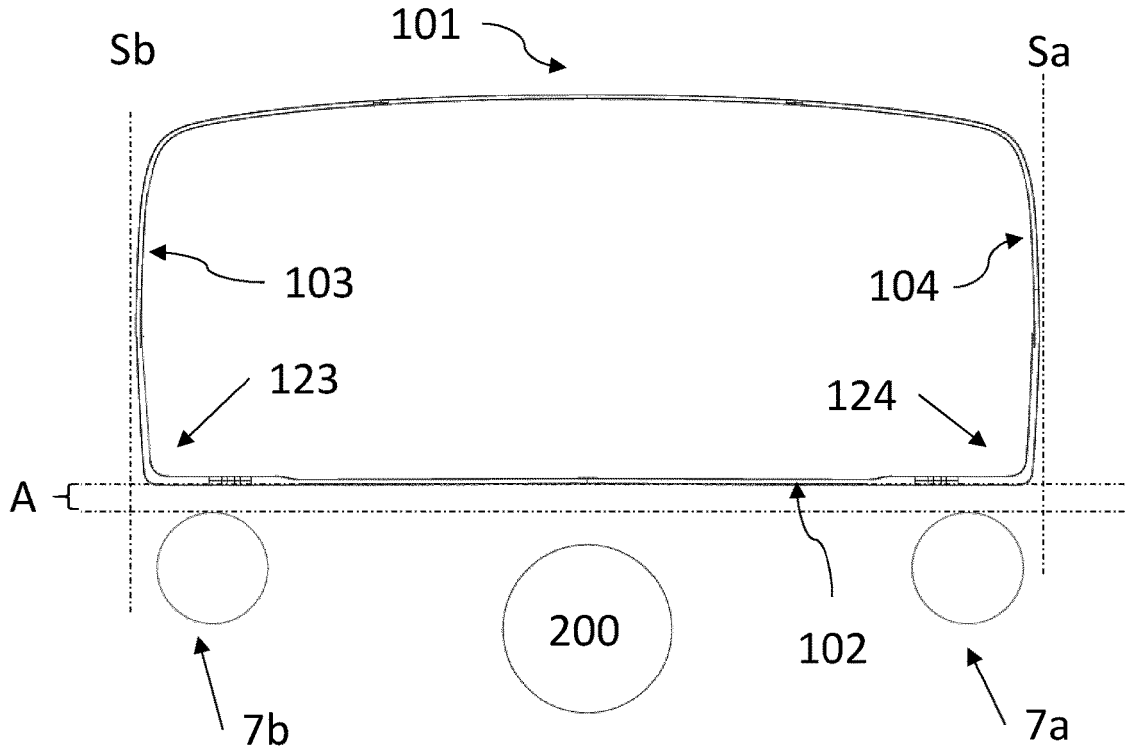

FIGS. 6 to 8 show a top view of the antenna housing 100 with profile elements 5*a*, 5*b*; 6*a*, 6*b*; 7*a*, 7*b* arranged on the real area 102. FIGS. 6 and 7 show the profile elements 5*a*, 5*b* or 6*a*, 6*b* as concave/convex profile elements 5*a*, 5*b* or 6*a*, 6*b* with a convexity that faces away from the antenna housing 100. They are arranged on an end area, preferably on the end area closest to the rear area 102, at a distance A, which is defined by two parallels through the apex of the transition area 123 or 124. In FIG. 6, the profile element 5*a* or 5*b* is arranged in such a way that it does not protrude from the imaginary line Sa or Sb toward the outside of the antenna housing 100 but is, at the most, flush with it. The profile element 6*a* or 6*b* in FIG. 7 is arranged in such a way that it protrudes from the imaginary line Sa or Sb toward the outside of the antenna housing 100. How far it protrudes from the imaginary line Sa or Sb must, once again, be determined by a person skilled in the art based on the type and arrangement of the antenna housing 100 in such a way that a striking airflow is channelled between the profile element 6*a* or 6*b* and the rear area 102.

FIG. 8 shows an alternative embodiment in which the profile element 7*a* or 7*b* is shown as a round element. Here as well, the profile element 7*a* or 7*b* is arranged at a distance A from the rear area 102. FIG. 8 shows an embodiment in which the profile element 7*a* or 7*b* does not protrude from the imaginary line Sa or Sb toward the outside of the antenna housing 100. A round profile element 7*a* or 7*b* may also, however, be arranged so that it protrudes from the imaginary line Sa or Sb toward the outside of the antenna housing 100.

In the embodiments shown in FIGS. 6 to 8, profile elements 5*a* and 5*b* or 6*a* and 6*b* or 7*a* and 7*b* are arranged close to the transition areas 123 or 124 to reduce the wind load by channelling the airflow that stalls in these two areas.

Preferably, the two profile elements 5*a* and 5*b* or 6*a* and 6*b* or 7*a* and 7*b* are each identically arranged on the rear area 102. That means that they are arranged symmetrically to the axis and/or the plane M which halves the antenna housing in its width.

FIGS. 13 and 14 show further embodiments where several through-openings 400 are additionally provided in the profile element 9 or 10. The boundary layer suction effect is used by these through-openings 400. A Laval nozzle is created between the profile element and the antenna housing, in which case, due to the air flowing through the through-opening, the dynamic pressure is reduced and a suction applied to the boundary layer. The suction at the boundary layer reduces the effective cross section of the flow, which reduces the wind load even further.

Figure 10:
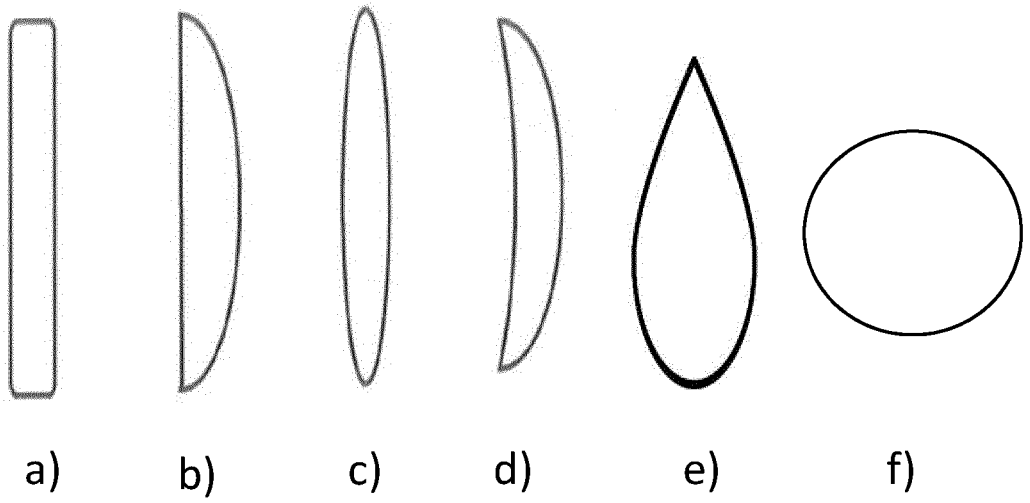

FIG. 10 shows different profiles that can be used for the profile elements 1*a*-8*a*; 1*b*-8*b*; 9; 10. It is possible to use a rectangular profile (indicated as a), a semi-circular profile (indicated as b), a profile that is concave on both sides (indicated as c), a profile that is convex on both sides, a concave/convex profile (indicated as d), a drop-shaped profile (indicated as e), a circular profile (indicated as f), or an oval profile. Furthermore, a profile adapted to the shape of the antenna housing 100 on the side facing the antenna housing as shown in FIGS. 1, 9 and 13 may be used.

FIGS. 15 to 20 show different fastening options for profile elements, which are provided here by way of example as concave/convex profile elements 4*a* and/or straight or contour-adapted profile elements 1*a* or 2*a*. Furthermore, they schematically show that the profile element may be formed from one piece across the height H of the antenna housing 100 (FIGS. 15, 17 and 19) or from a plurality of pieces (FIGS. 16, 18 and 20. If the profile element 1*a* or 2; 4*a* is made from a plurality of pieces or parts, the individual pieces or parts may be joined together or provided separately from each other. Within the meaning of this invention, a plurality of non-joined profile elements 1*a* or 2*a*; 4*a* may be referred to as a multi-part or multi-piece profile element 1*a* or 2*a*; 4*a* even if they can be produced and fastened independently from each other. The profile element 1*a* or 2*a*; 4*a* may, depending on the design and application area of the antenna housing 100, have approximately the same height H as the antenna housing 100. It may also, however, be less high or higher. The height may be determined by a person skilled in the art, for example in tests in the wind tunnel.

FIGS. 15 to 18 show a fastening of the profile element 1*a* or 2*a*; 4*a* with fastening elements 500, which serve at the same time as spacers from the antenna housing 100. These fastening elements 500 may be provided as an adhesive bond, in which case threaded bolts with relatively large, transparent elastomer pads are fixed on the antenna housing 100 on which the profile elements can be fastened. This has the advantage that no bores or holes must be provided in the antenna housing 100 so that undesired leaks can be prevented. It is possible to fasten any other form of the profile element in this manner as well.

FIGS. 19 to 20 show a fastening only of the profile element 4*a* shown in FIGS. 15 and 16 with fastening rails 501, which may also be formed as fastening strips. Any other form of the profile element may be fastened in this manner as well. These may be provided on the antenna housing 100 during production, for example with the corresponding guide grooves or thread, so that the profile element 4*a* can be fastened to them. It is possible to avoid holes and therefore leaks in the antenna housing 100 here as well. The fastening rails 501 or the fastening pieces provided for connection with the profile element 4*a* may, at the same time, serve as spacers from the antenna housing 100. These fastening rails 501 may also be fixed on the antenna housing 100 by means of an adhesive bond, for example with elastomer pads. This has the advantage that no bores and/or holes have to be provided in the antenna housing 100, so that undesired leaks can be prevented.

FIGS. 15, 16, 19, and 20 show, for purposes of simplification, only one profile element 4*a* on just one side of the housing 100 because these figures depict the fastening options in a schematic manner. As already described, however, it is preferable to fasten the profile element 4*a* on both side areas, i.e., symmetrical to the axis M. FIGS. 17 and 18 show profile elements 1*a* or 2*a* provided on both transition areas 113, 114. Since a contour-adapted profile element 1*a* has approximately the same shape when viewed from this perspective as a straight profile element 2*a*, no distinction is made here. Preferably, the same profile elements, i.e. profile element 1*a* or 2*a*, are arranged on both transition areas 113, 114.

By diverting the arising airflow, part of the air is channelled between the profile element and the antenna housing, thus reducing the wake area, whereby the wind load is reduced. This applies to all profile elements described.

More specifically, the wind load for frontal and side flows is reduced by providing the profile elements at locations on the antenna housing that are suitable for the respective application. It is furthermore possible to prevent the hydrofoil-like effect from being increased. It is also possible to retrofit existing antennas.

If cooling elements are present, it is also possible to provide a targeted guidance of cooling air flow for new, active antennas.

Some of the embodiments contemplated herein are described more fully with reference to the accompanying drawings. Other embodiments, however, are contained within the scope of the subject matter disclosed herein. The disclosed subject matter should not be construed as limited to only the embodiments set forth herein; rather, these embodiments are provided by way of example to convey the scope of the subject matter to those skilled in the art.

The present invention may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

LIST OF REFERENCE SIGNS

100 Antenna housing
1*a*-8*a*, 2*a*-8*b*, 9, 10 Profile element
101 Front area
102 Rear area
103, 104 Side area
113, 114; 123, 124 Transition area

105 Cover
106 Base
200 Pole
300 Cooling element
400 Through-openings
500; 501 Fastening elements, fastening rail
T Depth of the antenna housing
B Width of the antenna housing
H Height of the antenna housing
M Midline
Bp Width of the profile element
Sa, Sb Imaginary line for the extension of the side area
A Distance between the profile element and the antenna housing
Sp Imaginary line for determining the distance from the antenna housing
L Length by which the profile element protrudes from D
U Underpressure
9*a*; 9*b* Nozzle expansion; wake ventilation

The invention claimed is:

1. An antenna apparatus, comprising:
an antenna housing; and
a profile element fastened to the antenna housing at a distance away from the antenna housing, wherein the profile element is shaped so that it channels an airflow between the profile element and the antenna housing.

2. The antenna apparatus according to claim 1, wherein the profile element extends at least along a partial section of a height of the antenna housing.

3. The antenna apparatus according to claim 1, wherein the profile element comprises from one piece of a material.

4. The antenna apparatus according to claim 1, wherein the profile element is arranged on the antenna housing on:
(i) a side area,
(ii) a front area,
(iii) a rear area across from the front area, or
(iv) a transition area between two areas (i)-(iv) of the antenna housing.

5. The antenna apparatus according to claim 4, wherein one respective profile element is arranged on each transition area between the front area and an adjoining side area or on each transition area between the rear area and an adjacent side area of the antenna housing.

6. The antenna apparatus according to claim 4, wherein one respective profile element is arranged on each side area of the antenna housing, and wherein a width of the profile element is smaller than a depth of the antenna housing or approximately the same depth of the antenna housing, or wherein the profile element protrudes at the front area and/or the rear area of the antenna housing with a specified length from the depth of the antenna housing.

7. The antenna apparatus according to claim 1, wherein two profile elements are arranged on the rear area and/or a front area so that they protrude from, or are substantially flush with, a respective side area.

8. The antenna apparatus according to claim 1, wherein the profile element is adapted to a shape of the antenna housing and has one or more of the following shapes:
concave on both sides,
convex on both sides,
concave/convex,
rectangular,
square,
semi-circular,
drop-shaped,
circular, or
oval.

9. The antenna apparatus according to claim 1, wherein the profile element comprises through-openings from a side facing the antenna housing to a side facing away from the antenna housing.

10. The antenna apparatus according to claim 1, wherein the profile element is fastened to the antenna housing by means of at least two fastening elements spaced apart from each other, or by one fastening rail.

11. The antenna apparatus according to claim 10, wherein the at least two fastening elements and/or the fastening rail is fastened to the antenna housing by means of an adhesive bond.

12. The antenna apparatus according to claim 1, wherein the profile element comprises:
aluminum, or
plastic, or
glass fibre reinforced plastic.

* * * * *